United States Patent [19]

Aubert

[11] Patent Number: 4,736,176

[45] Date of Patent: Apr. 5, 1988

[54] TRANSITION DISK IN A SOLENOIDAL MAGNET WITH BITTER TYPE ANNULAR DISKS

[75] Inventor: Guy Aubert, Grenoble, France

[73] Assignee: Thomson-CGR, Paris, France

[21] Appl. No.: 939,157

[22] PCT Filed: Feb. 21, 1986

[86] PCT No.: PCT/FR86/00058

§ 371 Date: Nov. 14, 1986

§ 102(e) Date: Nov. 14, 1986

[87] PCT Pub. No.: WO86/05625

PCT Pub. Date: Sep. 25, 1986

[30] Foreign Application Priority Data

Mar. 19, 1985 [FR] France ..... 85 04051

[51] Int. Cl.[4] ..... H01F 7/20

[52] U.S. Cl. ..... 335/299; 336/232; 324/320

[58] Field of Search ..... 335/299; 336/227, 232; 324/318, 319, 320, 321

[56] References Cited

FOREIGN PATENT DOCUMENTS 1290248 3/1969 Fed. Rep. of Germany ..... 335/299
1209196 2/1960 France ..... 335/299

OTHER PUBLICATIONS

WO83/02522, PCT, Composite Coils for Toroidal Field Coils and Method of Using Same, R. Pericins et al.

*Primary Examiner*—George Harris
*Attorney, Agent, or Firm*—Oblon, Fisher, Spivak, McClelland & Maier

[57] ABSTRACT

A structure is provided for connection between Bitter coils in a magnet with homogeneous field. The magnet is formed of several Bitter coils joined side by side and whose disks are of different thicknesses and two adjacent coils are connected together by a transition disk forming a turn and having for example a set-back on each of its faces for adapting it to the different thicknesses of the disks of two coils.

6 Claims, 2 Drawing Sheets

TRANSITION DISK IN A SOLENOIDAL MAGNET WITH BITTER TYPE ANNULAR DISKS

BACKGROUND OF THE INVENTION

1. Field of the Invention

The invention, due to the collaboration of the National Intense Fields Dept. of the CNRS (Director M. Aubert) relates to a solenoidal magnet formed of a stack of annular disks, better known under the name of Bitter magnet; the invention relates more particularly to this type of magnet with a view to obtaining a magnetic field having the required homogeneity in a given volume in the region of the center of the magnet, one of the priviliged applications of the invention being image formation by nuclear magnetic resonance (NMR).

It is known that NMR image forming installations, among other things, require a large sized magnet capable of generating a uniform magnetic field in a given region of space. Typically, it is necessary to generate a field of 0.15 to 0.5 teslas with a homogeneity of 1 to 10 parts per million (ppm) in a sphere having a diameter a diameter of 40 cm at least.

2. Description of the Prior Art

Bitter coils are well known for the production of intense magnetic fields. In theory, the structure proposed by Bitter is a coil formed of annular metal disks (generally made from copper or aluminium), split so as to form as many turns and connected together so as to define a substantially helical winding with flat turns. The stack of disks is held in position by a plurality of tie rods. This structure is advantageous for it allows efficient cooling of the magnet, by forming holes in the disks (and in the insulators separating these disks), these holes being disposed in the same configuration from one disk to another so as to form an assembly of channels parallel to the axis of the coil, in which a cooling fluid flows, for example deioinized water, kerosene or oil.

In accordance to what is described in another patent application of the applicant, it is possible to calculate a magnet delivering a magnetic field of required homogeneity in a certain volume in the vicinity of its center of symmetry and formed of a certain number of Bitter coils joined side by side along a common longitudinal axis, these coils being constructed from disks all having the same inner and outer diameter, but of different thicknesses from one coil to another. The invention relates principally to a structure for connecting such coils, providing a perfectly rectilinear stack of said coils while distrubuting little the magnetic fields such as calculated from a theorectical model neglecting the technological constraints for connecting the coils and keeping the continuity of the cooling fluid channels.

SUMMARY OF THE INVENTION

In this spirit, the invention relates then essentially to a solenoidal magnet comprising Bitter type annular disks, of the same inner and outer diameters and including several coils of such disks joined side by side along a common longitudinal axis, wherein, with the disks of any two adjacent coils being of different thicknesses, two adjacent coils are connected together by means of a flat annular transition disk, forming a turn of the same inner and outer diameter as said disks and said transition disk has at least one thickness variation, depending on the difference of thickness of the disks of said adjacent coils.

The Bitter disks are conventionally stacked with interpositioning of insulators and all have the same configuration of holes for defining a cluster of channels parallel to the longitudinal axis of the magnet, in which the cooling fluid is caused to flow. Of course, said transition disks have the same configuration of holes for ensuring continuity of the cooling circuit inside all the series coils. In one possible embodiment, the transition disk may have a set-back on each of its faces, the height of this set-back corresponding to the helical pitch of the coil connected to this face. In another possibility, the transition disk may have a thickness of the same order of size as that of the disks of the adjacent coils and more particularly itself form one or more turns of regularily varying thickness, the thicknesses of the two ends of this or of these turns being respectively equal to the thicknesses of the turns of the two adjacent coils.

BRIEF DESCRIPTION OF THE DRAWINGS

The invention will be better understood and other advantages thereof will be clearer from reading the following description given solely by way of example with reference to the accompanying drawings in which.

DESCRIPTION OF THE PREFERRED EMBODIMENT OF THE INVENTION

Figure 1:
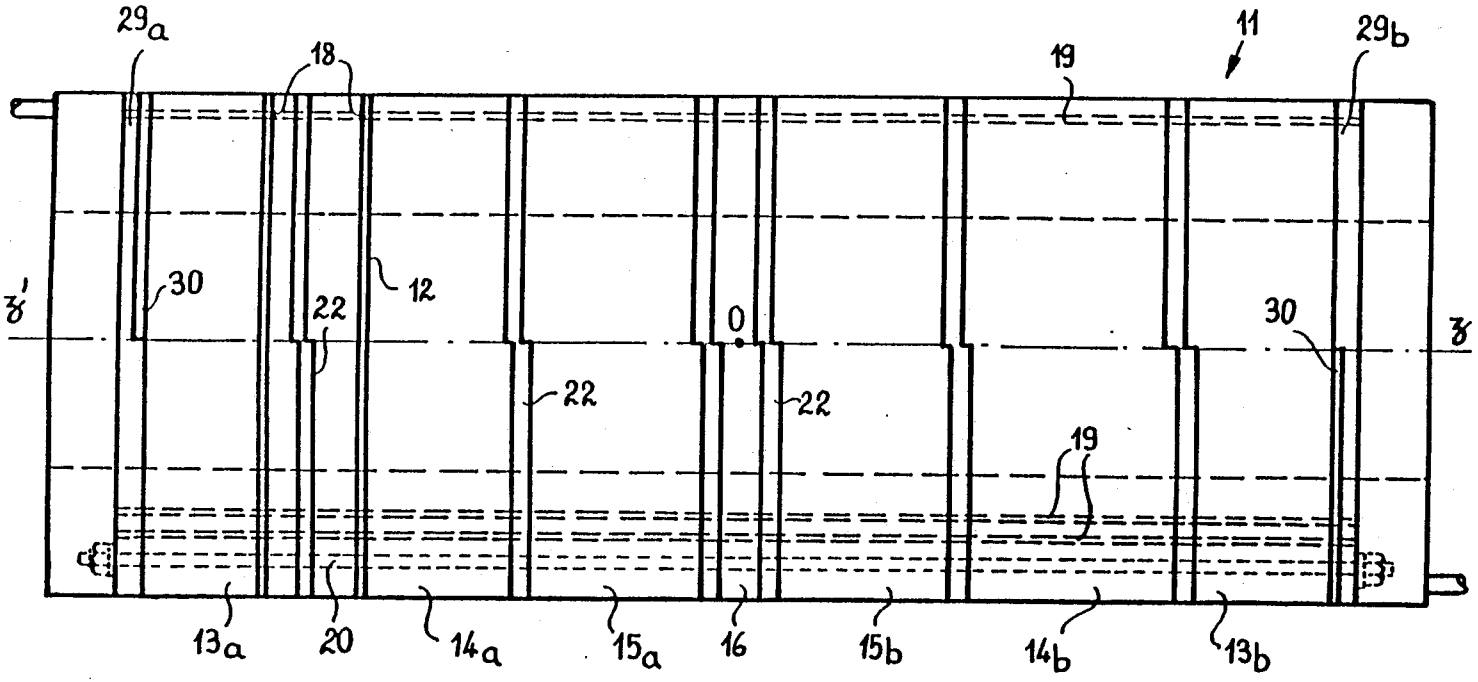
FIG. 1 is a schematical sectional view of a magnet consistent with the principle of the invention.

Referring to the drawings a solenoidal magnet 11 has been shown with annular Bitter disks 12, formed of several coils 13*a*, 14*a*, 15*a*, 16, 13*b*, 14*b*, 15*b* joined side by side along a common longitudinal axis z'z. For application to NMR image formation, it is possible to obtain a magnetic field of required homogeneity (1 to 10 ppm) in a sphere of interest of sufficient volume whose center 0 merges with that of the magnet, if this magnet is formed for example from 7 Bitter type coils joined side by side along the axis z'z, the disk lengths and thicknesses of the different coils being chosen so as to obtain said required homogeneity. In so far as the thicknesses of the disks is concerned, it should be noted that the disks of any two adjacent coils are of different thicknesses, but that the disks of two coils symmetrical with respect to the transverse medium plane passing through 0 (13*a*–13*b*, 14*a*–14*b*, 15*a*–15*b*) are of the same thickness. One possible method of calculating the characteristics of the coils of the magnets is given in another patent application No. 84-19192 filed by the applicant and does not form part of the invention described here. By Bitter type coil is meant any coil answering the above recalled definition. For this reason, disks 12, whatever their thicknesses, have the same configuration of holes 18 forming an assembly of channels 19 parallel to the axis z'z and in which the cooling fluid flows. Disks 12, split radially, are connected end to end and are held in a tight stack by means of a plurality of tie rods 20 evenly spaced apart over a cylindrical surface with axis z'z. Thin insulating foils (not visible in the drawings) are inserted between the disks for providing insulation between turns; they have the same confirugation of holes forming the channels.

According to the invention, any two adjacent coils are connected end to end by means of a flat annular transition disk 22, forming a turn, and this disk has at least one thickness variation depending on the difference of thickness of the disks of said adjacent coils.

Figure 2:
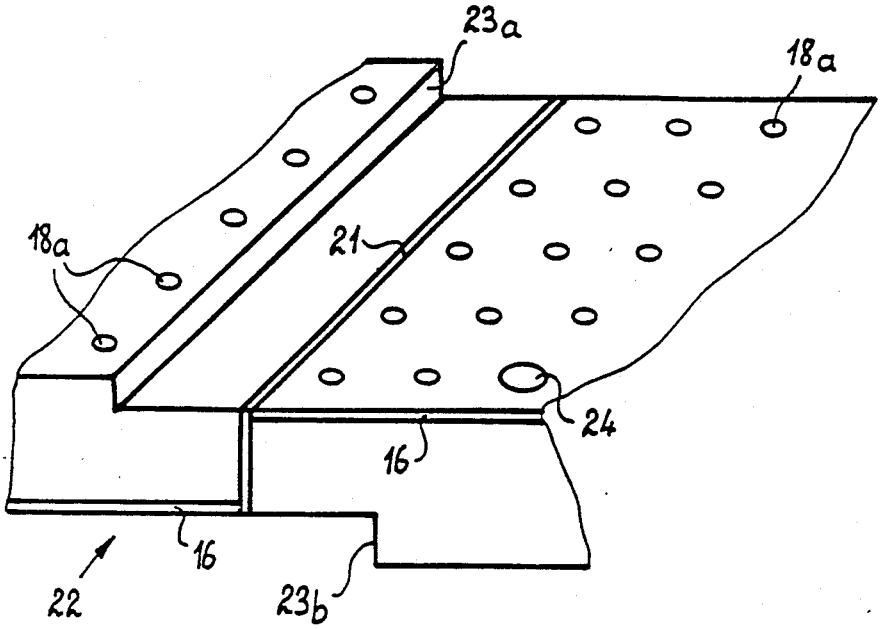
FIG. 2 is a partial perspective view of a transition disk of FIG. 1.
Figure 3:
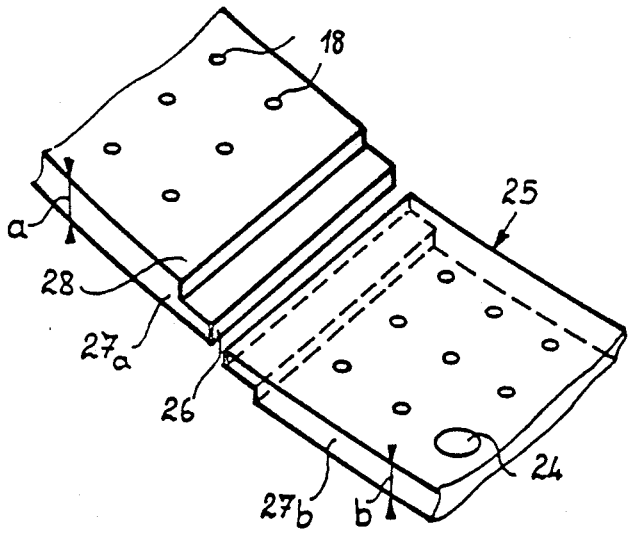
FIG. 3 is a partial perspective view of another embodiment of a transition disk.

In fact, a stack of Bitter disks of the same thickness results in a rectilinear structure but a change of thickness could result in a stack which is non rectilinear and/or having coiling irregularities even leaks of cooling fluid. All these defects are avoided by the presence of the above defined transition disks. In the embodiment shown in FIG. 2, each transition disk is in the form of a thin annular metal plate (copper or aluminium) of the order of a few turns of the magnet, and having a slit 21 for defining a turn. This plate has a setback 23*a*, 23*b* on each of its faces, respectively, on each side of slit 21 and whose height corresponds to the helical pitch of the coil connected to this face. The end of each coil is welded over the whole part situated between the corresponding set-back and the slit 21, the surface of the plate situated on the other side of this slit being covered with a thin insulating foil 16. Advantageously, slit 21 is filled with insulating resin (a polymerizable bonding agent) which restores a certain rigidity to the transition disk and facilitates assembly of the coils of the magnet. Furthermore, the transition disk also has the same configuration of holes 18*a* as the Bitter disks 12 of the different coils, for cooling, as well as a series of larger diameter holes 24 for passing the tie rods therethrough. The presence of the transition disks is taken into consideration in the calculation of the magnet. Furthermore, it may be advantageous to form the transition disks as thin as possible. To this end, the embodiment shown in FIG. 3 gives a concrete example of the limit case when it is desired to reduce the thickness of the transition disk. It is a question of a metal disk 25 (made from copper or aluminium) having a radial slit 26 transforming it into a turn and the thickness of this turn is regularily variable so that the thicknesses a and b of these ends 27*a*, 27*b* are respectively equal to the disk thickness of the two adjacent coils. Each of the ends 27*a*, 27*b* further has a tongue or groove 28 for a welded connection to the adjacent disk of the corresponding coil, which has a complementary tongue or groove. Of course, the transition disks 25 have the same configuration of holes as in the case of FIG. 2. Furthermore, referring again to FIG. 1, it will be noted that the whole of the magnet is clamped, by the tie rods, between two current distribution plates 29*a* and 29*b*. These plates are in the form of thick annular disks and have the same inner and outer diameter as disks 12. One of the faces of each disks has a set-back 30 having a height substantially equal to the disk thickness of the adjacent coil 13*a* or 13*b*.

What is claimed is:

1. A solenoidal magnet with Bitter type annular disks of the same inner and outer diameters, comprising:

coils of Bitter type annular disks joined side by side along a common longitudinal axis, the disks of any two adjacent coils being of different thicknesses;

a flat annular transition disk forming a turn and connecting two adjacent coils; and said flat annular transition disk having at least one thickness variation depending on the difference of thicknesses of the Bitter type annular disks of said adjacent coils.

2. The solenoidal magnet according to claim 1, wherein said flat annular transition disk has a set-back on each of its faces, each said set-back of a height corresponding to the helical pitch of the coil connected to the face.

3. The solenoidal magnet according to claim 1, wherein said flat annular transition disk is split substantially radially so as to define a turn.

4. The solenoidal magnet according to claim 1, wherein said flat annular transition disk is a turn of regularly varying thickness, the thicknesses of the two ends of said turn being respectively equal to the disk thicknesses of the two said adjacent coils.

5. The solenoidal magnet according to any one of the preceding claims, further comprising:

a current distribution plate at each end thereof, in the form of a thick annular disk of the same inner and outer diameters as said Bitter type annular disks and said flat annular transition disk; and wherein one of the faces of said current distribution plate has a set-back having a height substantially equal to the disk thickness of the adjacent coil.

6. The solenoidal magnet according to claim 3, wherein a slit defining said turn is filled with insulating resin or a similar insulating material.

* * * * *